US012185818B2

(12) United States Patent
Leroux

(10) Patent No.: US 12,185,818 B2
(45) Date of Patent: Jan. 7, 2025

(54) DEVICE FOR PACKAGING AND APPLYING A FLUID PRODUCT

(71) Applicant: L'OREAL, Paris (FR)

(72) Inventor: Stephane Leroux, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 18/280,361

(22) PCT Filed: Mar. 15, 2022

(86) PCT No.: PCT/EP2022/056721
§ 371 (c)(1),
(2) Date: Sep. 5, 2023

(87) PCT Pub. No.: WO2022/200128
PCT Pub. Date: Sep. 29, 2022

(65) Prior Publication Data

US 2024/0074562 A1 Mar. 7, 2024

(30) Foreign Application Priority Data

Mar. 24, 2021 (FR) ..... 2102941

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01); *A45D 2200/05* (2013.01)

(58) Field of Classification Search
CPC ..... A45D 40/267; A45D 2200/05; A45D 34/046; A45D 34/042; A45D 40/262; A45D 34/045; A45D 40/265
(Continued)

(56) References Cited

U.S. PATENT DOCUMENTS 5,875,791 A * 3/1999 Sheffler ..... A45D 40/267 401/122
9,622,565 B2 4/2017 Weigel et al.
2013/0101337 A1* 4/2013 Kulik ..... A45D 40/267 401/122

FOREIGN PATENT DOCUMENTS

CA 2351800 A1 12/2001
EP 1614367 A1 1/2006
(Continued)

OTHER PUBLICATIONS

International Search Report (ISR) for PCT/EP2022/056721 mailed May 3, 2022 (4 pages).
(Continued)

*Primary Examiner* — David J Walczak
(74) *Attorney, Agent, or Firm* — Shumaker, Loop & Kendrick, LLP

(57) ABSTRACT

A Device for packaging and applying a fluid product having:
—a container having a neck, an applicator, having an applicator member borne by a stem and at least one fastening relief protruding from the stem, and a component molded in one piece, for retaining the applicator and wiping the applicator member, fastened to the container, this component having a wiping part and a retaining part having at least one retaining relief beneath which said fastening relief engages when the applicator is mounted on the container, the wiping part being connected on only a portion of its periphery to the retaining part, so as to provide at least one opening beneath said retaining relief, this opening emerging axially away from the retaining relief.

19 Claims, 12 Drawing Sheets

(58) Field of Classification Search
USPC ..... 401/121, 122, 126–130
See application file for complete search history.

(56) References Cited

FOREIGN PATENT DOCUMENTS

| | | | |
|---|---|---|---|
| FR | 3029080 | A1 | 6/2016 |
| FR | 3066889 | A1 | 12/2018 |
| FR | 3079397 | A1 | 10/2019 |
| GB | 2473105 | A | 3/2011 |
| KR | 101866140 | B1 | 6/2018 |
| WO | 2019/043955 | A1 | 3/2019 |

OTHER PUBLICATIONS

Written Opinion (WO) for PCT/EP2022/056721 mailed May 3, 2022 (6 pages).

* cited by examiner

DEVICE FOR PACKAGING AND APPLYING A FLUID PRODUCT

TECHNICAL FIELD

The present invention relates to a device for packaging and applying a product, in particular a cosmetic product, having a container containing the product to be applied and an applicator having an applicator member that can be loaded with product by being dipped in the container.

BACKGROUND

Such devices are conventionally provided with a wiper that is fastened to the neck of the container, if appropriate using a retaining component, and makes it possible to wipe off the applicator member and the stem that bears it during withdrawal thereof from the container.

Generally, the stem is borne by a cap for closing the container that also constitutes a member for gripping the applicator.

In the majority of devices, the closure cap is screwed onto the neck of the container, which is then externally threaded.

Devices with a quarter-turn opening/closure system (or "key opening" system) have however been proposed.

An example of such a device is illustrated in FIGS. 1 and 2. It has a wiper 2 immobilized in the neck by a retaining component 1, which is separate from the wiper 2. The retaining component 1 has reliefs 4 that cooperate with corresponding reliefs of the stem so as to ensure the quarter-turn fastening of the applicator.

This type of device is very popular with consumers since it allows quick and easy opening/closure. By contrast, it is relatively expensive to produce since it is made with an assembly of a plurality of components that have to be molded separately.

The application WO 2019/043955 discloses a similar device, having a container with a neck in which the wiper is fastened via a retaining component produced separately.

The U.S. Pat. No. 9,622,565 discloses an applicator for applying a cosmetic product, in particular mascara, having a container and a closure cap that is produced in one piece with a stem bearing an applicator member. The container has a neck provided with lugs beneath which retaining reliefs of the cap engage in the closed configuration.

SUMMARY

There is a need to benefit from a device for packaging and applying a product, in particular a cosmetic product, which is economical to manufacture, while at the same time allowing rapid opening/closure of the container and satisfactory wiping of the stem and of the applicator member.

The invention aims to meet this need and achieves this by virtue of a device for packaging and applying a fluid product, in particular a cosmetic product, having:

- a container for containing the product, this container having a neck,
- an applicator for applying the product, having an applicator member borne by a stem and at least one fastening relief protruding from the stem, and
- a component molded in one piece, for retaining the applicator and wiping the applicator member, fastened to the container, this component having

- a wiping part configured to press against the stem and/or the applicator member, extending all around the longitudinal axis of the stem when the applicator is in place in the container, and
- a part for retaining the applicator, having at least one retaining relief beneath which said fastening relief engages when the applicator is mounted on the container, the wiping part being connected on only a portion of its periphery to the retaining part, so as to provide at least one opening beneath said retaining relief, this opening emerging axially away from the retaining relief.

The term "cosmetic product" denotes a makeup or care product intended to be applied to human keratin materials. The cosmetic product can be in liquid or cream form, for example. The cosmetic product can be mascara, an eyeliner, an eyeshadow, a foundation, a lipstick, a lip gloss or a lip balm.

The term "keratin materials" denotes the skin, including the scalp, the lips, the nails, the hair, the eyelashes and the eyebrows. The applicator member can be intended for the lips or facial skin, in particular that of the eyelids or of the cheeks, or the eyelashes or eyebrows.

The invention makes it possible to perform the functions of wiping and retaining the applicator on the container by virtue of a single component fastened to the container. It is thus possible to manufacture the device with a smaller number of constituent components, and this reduces the manufacturing cost thereof.

Preferably, the applicator has at least two fastening reliefs, in particular only two fastening reliefs that are diametrically opposite one another, and the wiping part is connected on only a portion of its periphery to the retaining part, so as to provide at least two respective openings beneath said retaining reliefs, the two openings emerging axially away from the retaining reliefs, in particular only two respective openings.

Preferably, the device has as many openings as there are fastening reliefs.

The two fastening reliefs that are diametrically opposite one another make it possible to ensure correct closure of the device. As a variant, the device can have four openings and four fastening reliefs. The device can then be completely opened and closed by turning the applicator through one eighth of a turn.

The retaining part may have one or more immobilizing reliefs, in particular two immobilizing reliefs, which are preferably diametrically opposite one another, which the fastening relief or reliefs can pass over by elastic deformation so as to reversibly prevent the applicator from rotating on the container. This or these immobilizing reliefs make it possible to lock the device in the position closing the container, and to reduce the risk of accidental opening. In addition, they allow the user to easily identify when the device is locked by generating a hard point when the immobilizing reliefs are passed over.

The one or more immobilizing reliefs may each have a boss disposed between two notches. The notches make the deformation of the boss, in particular in the radial direction, easier when the fastening relief presses it so as to pass over it. The elastic deformation of the immobilizing reliefs is then made easier. The risk of the one or more immobilizing reliefs wearing and breaking is thus reduced.

The retaining part is preferably configured to allow a rotation of substantially 90° of the applicator about the longitudinal axis of the stem between the position of withdrawal of the applicator and the position closing the container. The device can then be completely closed and/or opened by turning the applicator through approximately a quarter of a turn. In the position closing the container, the fastening reliefs of the stem are immobilized beneath the retaining reliefs of the retaining and wiping component.

The wiping part may have a wiping lip and a first sealing lip that presses against the neck of the container.

The wiping part may have a second sealing lip that presses against the stem of the applicator when the device is in the position closing the container. This second sealing lip makes it possible to prevent leaks of product between the wiper and the stem.

A groove may be formed between the second sealing lip that presses against the stem of the applicator and each bridge of material that connects the retaining part and the wiping part. The width of this groove may be between 0.1 mm and 5 mm, for example it may be of the order of 1 mm. The invention makes it possible to have a relatively narrow groove.

Preferably, the retaining part has a skirt for mounting on the container. This mounting skirt may externally cover the neck of the container, and for example cover only the neck of the container. In a variant, the mounting skirt covers the container over its entire height.

The mounting skirt may be arranged such that one end of the mounting skirt can be fastened to a relief such as an annular bulge, which is disposed in particular at the base of the neck.

The applicator according to the invention may have a gripping part produced in one piece with the stem, and this makes it possible to limit the number of constituent components of the device.

Preferably, the applicator has no ballast, and this makes recycling thereof easier.

The retaining relief may have a thread, which is for example inclined downward when turning in the clockwise direction about the longitudinal axis of the stem.

This thread makes it possible to guide one of the fastening reliefs toward one of the openings during return of the applicator into the container. The thread may have portions of variable inclination. At least one portion of the thread can have an inclination greater than 5°, better still greater than 20°, for example of the order of 25° with respect to a plane perpendicular to the longitudinal axis of the stem. Such a relatively steeply inclined portion allows very rapid raising and lowering of the applicator in the container. By virtue of this, the consumer perceives unambiguously that the applicator passes from the closure position to the withdrawal position and vice versa.

Preferably, the retaining part and the wiping part are made of a thermoplastic material, in particular polyethylene terephthalate (PET) or polypropylene (PP) or polyethylene (PE). These materials have the advantage of being materials that are inexpensive and easy to mold. The retaining part and the wiping part are preferably made of the same material. As a variant, the retaining part and the wiping part are made of different materials.

Another subject of the invention, according to another of its aspects, is a method for demolding the component for retaining the applicator and wiping the applicator member of a device according to the invention, said component being molded in a mold in two parts, the demolding being carried out by moving the two parts of the mold along the axis of the component, in opposite directions.

BRIEF DESCRIPTION OF THE DRAWINGS

The invention may be better understood upon reading the following detailed description of a non-limiting implementation example thereof and upon studying the appended drawing, in which:

FIG. 4*b* is a view similar to FIG. 4*a* in the same section plane as

FIG. 3,

FIG. 9 is a view in section of the retaining and wiping component in

FIG. 5,

DETAILED DESCRIPTION

In the figures and in the rest of the description, the same numerical references represent identical or similar elements.

Figure 1:
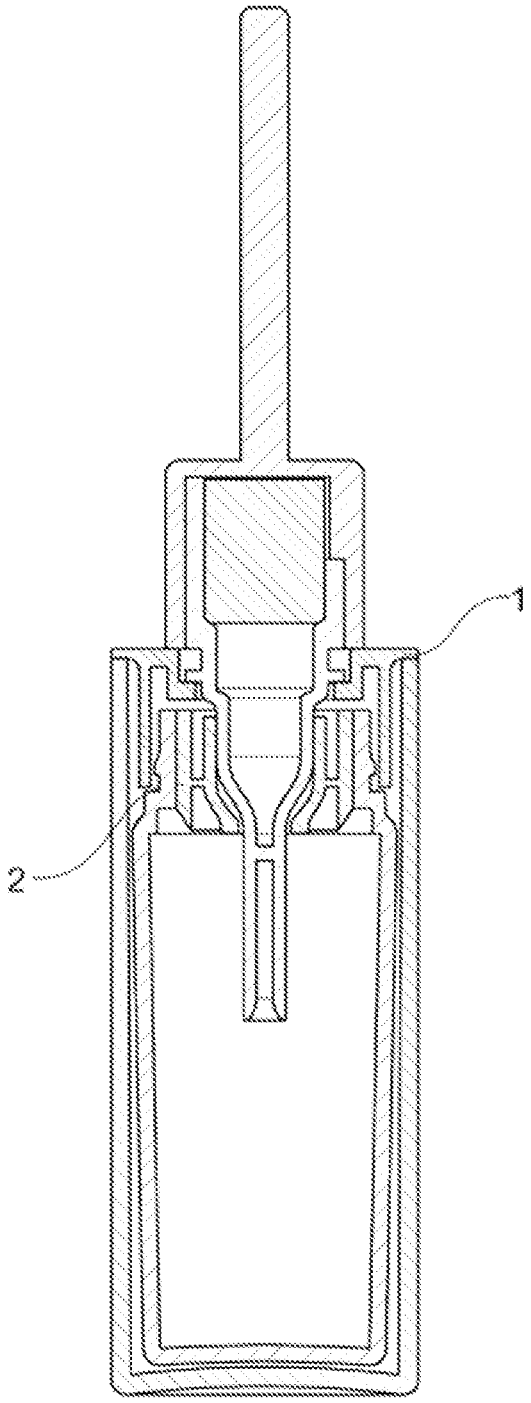
Fig. 1 Prior art
FIG. 1, described above, shows a device from the prior art.
Figure 2:
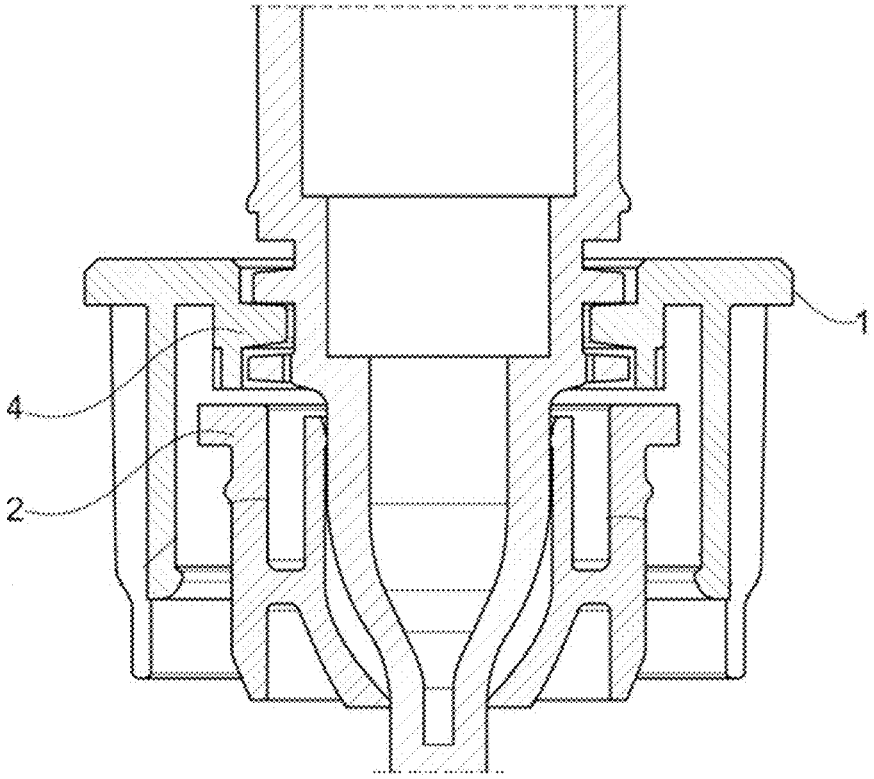
Fig. 2 Prior art
FIG. 2 shows a detail of the device in FIG. 1.
Figure 3:
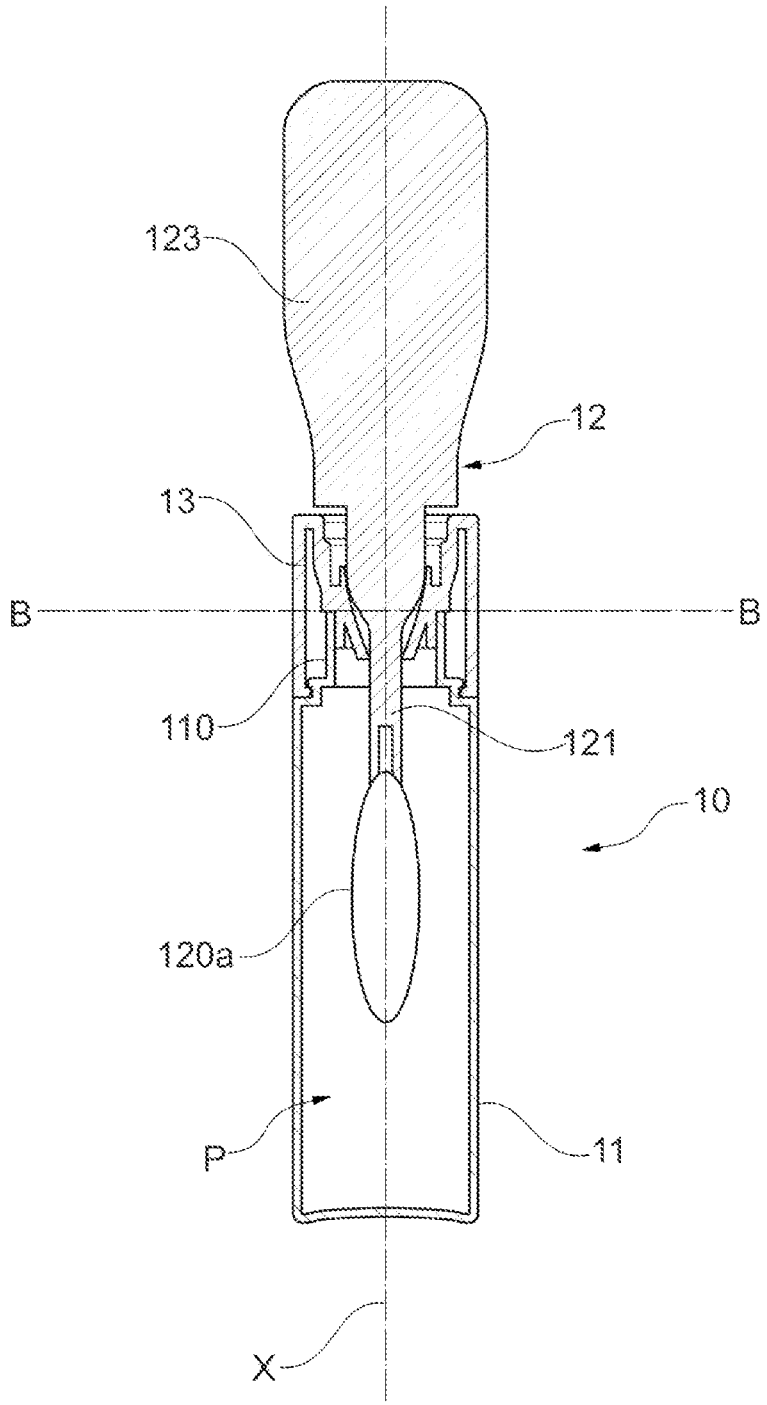
FIG. 3 is a partial and schematic longitudinal section of an example of a packaging and application device according to the invention.

FIG. 3 illustrates an example of a device 10 for packaging and applying a fluid product P, in particular a cosmetic product, according to the invention. This device 10 has a container 11 containing the product P. This container 11 has a neck 110 at one of its ends.

The device 10 has an applicator 12 for applying the product P. This applicator 12 has a stem 121 of longitudinal axis X, with an end 120 intended for the fastening of an applicator member 120*a*, for example an elastomer or felt end piece, a flocked tip, a mascara brush with a twisted metal core or produced by injection-molding or an additive manufacturing technique, or a fine brush.

Figure 4A:
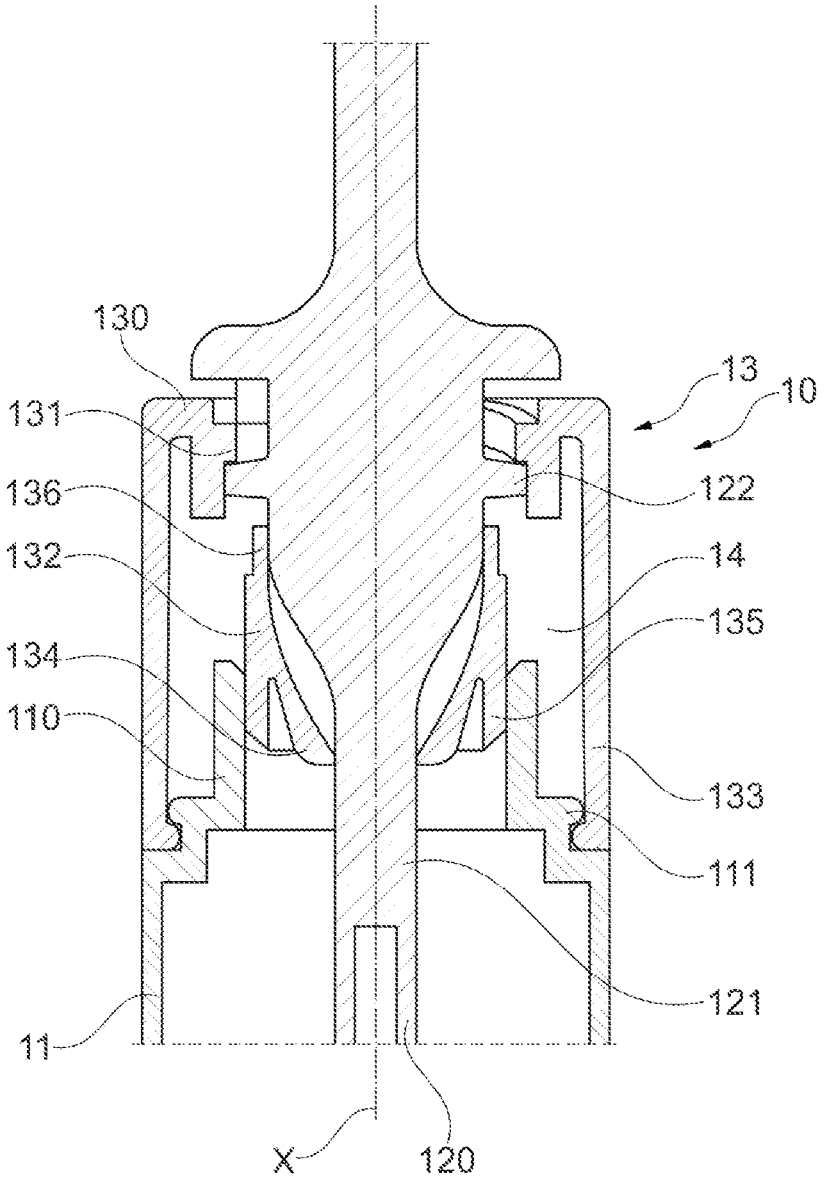
FIG. 4*a* is a detail of the device in FIG. 3 in a section plane perpendicular to that of FIG. 3.
Figure 4B:
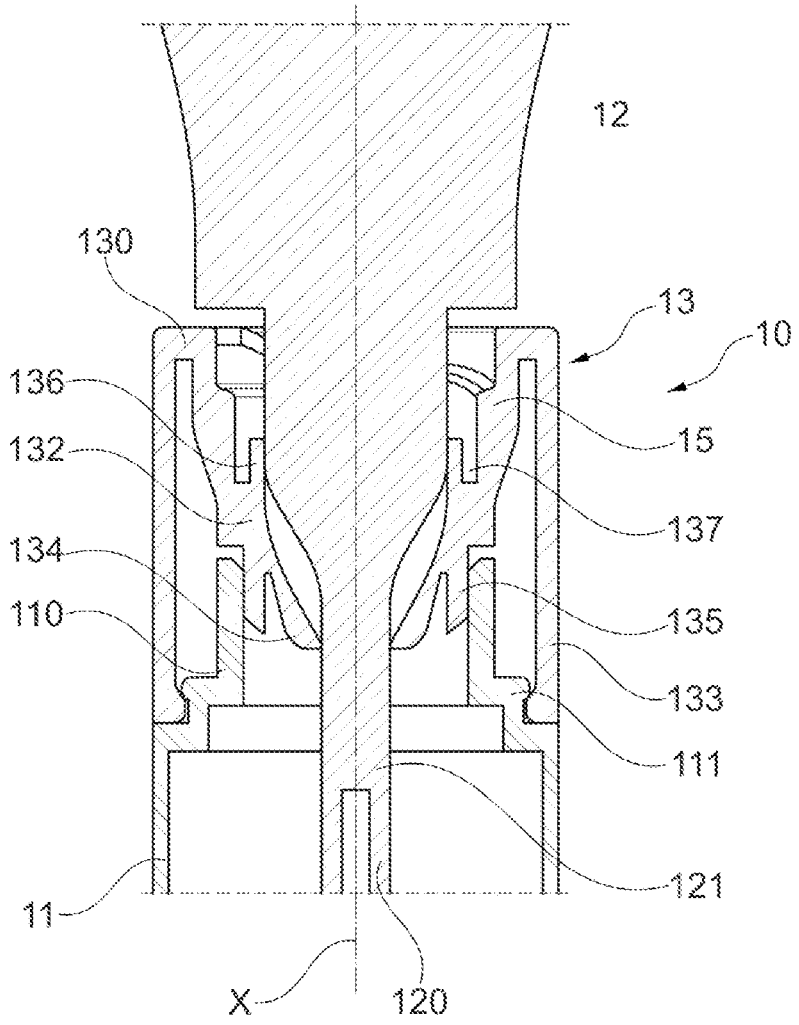
Figure 5:
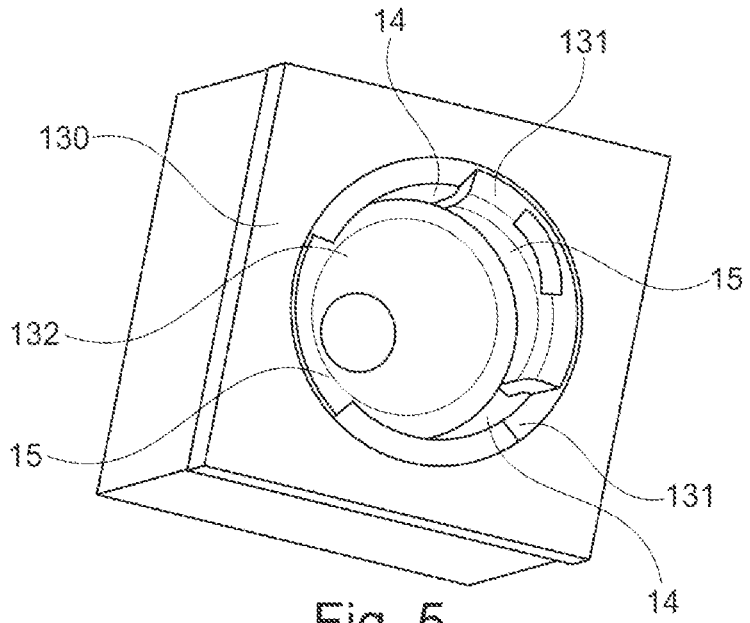
FIG. 5 shows the retaining and wiping component of the device in FIG. 3 on its own, in perspective.
Figure 6:
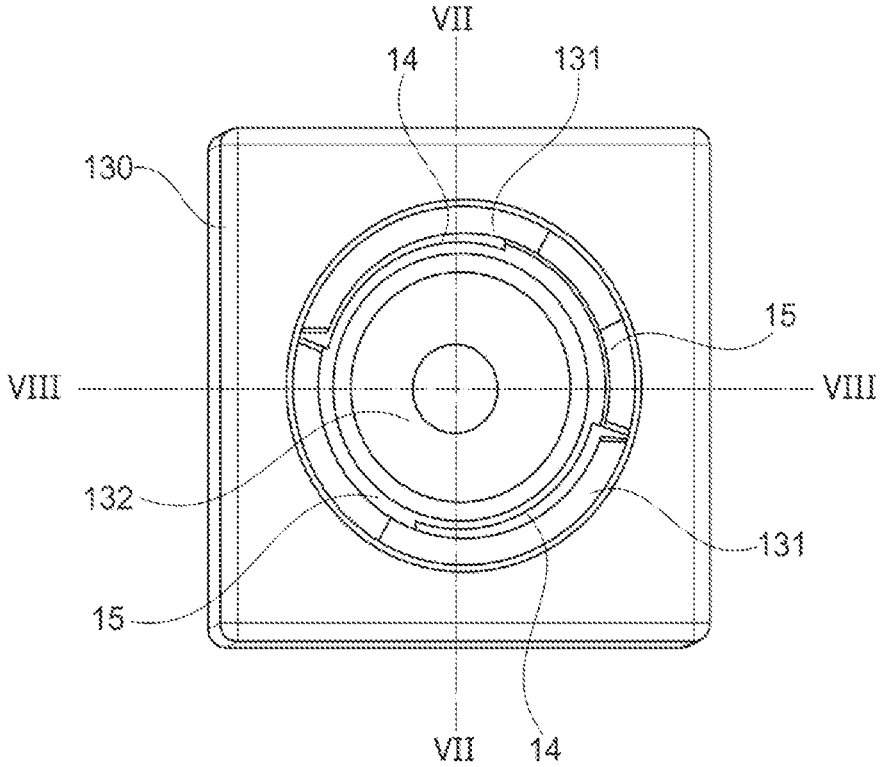
FIG. 6 is a top view of the retaining and wiping component in FIG. 5.
Figure 7:
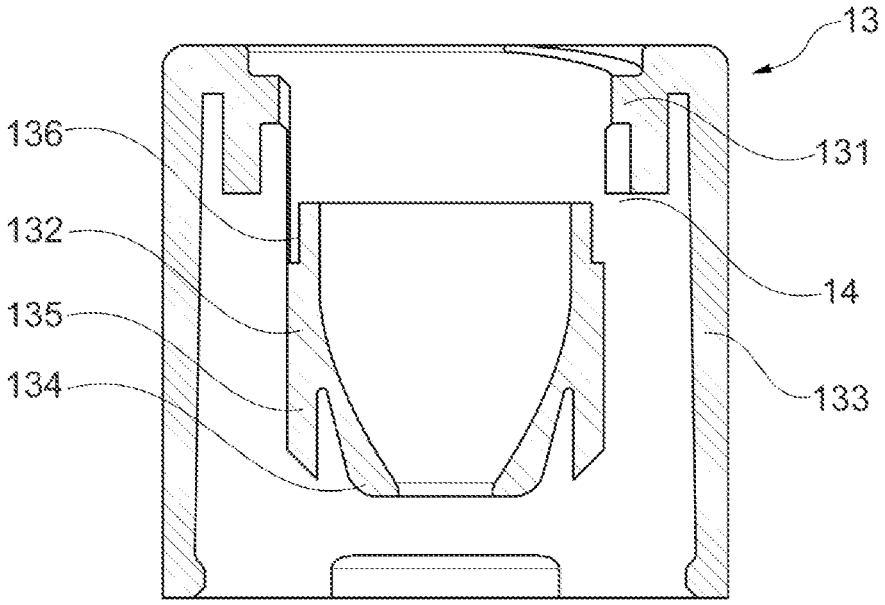
FIG. 7 is a view in section on VII-VII of the retaining and wiping component in FIG. 6.
Figure 8:
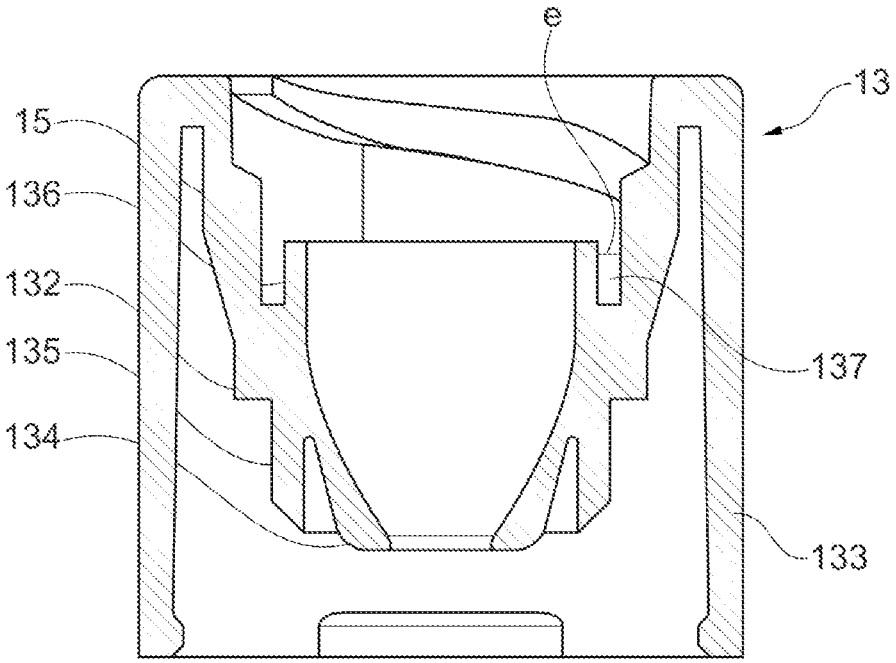
FIG. 8 is a view in section on VIII-VIII of the retaining and wiping component in FIG. 6.

Two fastening reliefs 122 protrude from the stem 121, and can be seen more particularly in FIGS. 4*a* and 4*b*. The applicator also has a gripping part 123. In the embodiment illustrated, the gripping part 123 and the stem 121 form a single component, obtained by injection molding.

The fastening reliefs 122 are formed in this example by two lugs that are diametrically opposite one another, which are molded with the stem 121.

The device 10 has a component 13 retaining the applicator on the container when the latter is closed, and wiping the applicator member and the stem during withdrawal of the applicator.

As can be seen in FIGS. 4*a* and 4*b*, this component 13 has a part 130 for retaining the applicator 12. This retaining part 130 has two retaining reliefs 131 beneath which the two fastening reliefs 122 engage when the applicator is mounted on the container 11. When the fastening reliefs 122 are engaged beneath the retaining reliefs 131, the device 10 is in the position closing the container.

The retaining component 13 has a tubular skirt 133 for mounting on the container 11. The mounting skirt 133 covers the neck 110 of the container 11 and is fastened at one of its ends beneath an annular bulge 111 disposed at the base of the neck 110.

The component 13 also has a wiping part 132 configured to press against the stem 121 when the applicator is in place on the container.

The wiping part 132 extends all around the longitudinal axis X of the stem 121 when the applicator 12 is in place in the container 11. The wiping part 132 has an annular wiping lip 134 that makes it possible to remove the excess product P present on the applicator member when the applicator is withdrawn from the container 11.

The wiping part 132 has a first annular sealing lip 135 that presses against the neck 110 of the container and a second annular sealing lip 136 that presses against the stem 121 of the applicator 12, when the latter is in place on the container. These lips 135 and 36 are coaxial with the longitudinal axis of the container.

As can be seen in FIGS. 5 to 8, the wiping part 132 is connected on only a portion of its periphery by bridges of material 15 to the retaining part 130, so as to provide two openings 14 beneath the retaining reliefs 131. Each opening 14 emerges axially away from the retaining relief 131 beneath which it is located. The retaining part 130 and the wiping part 132 are connected to each other by two bridges of material 15. A groove 137, which can be seen in FIG. 4*b*, is formed between the first sealing lip 135 and the adjacent bridge of material 15 that connects the retaining part 130 and the wiping part 132. The width e of this groove 137 is for example of the order of 1 mm.

Figure 9:
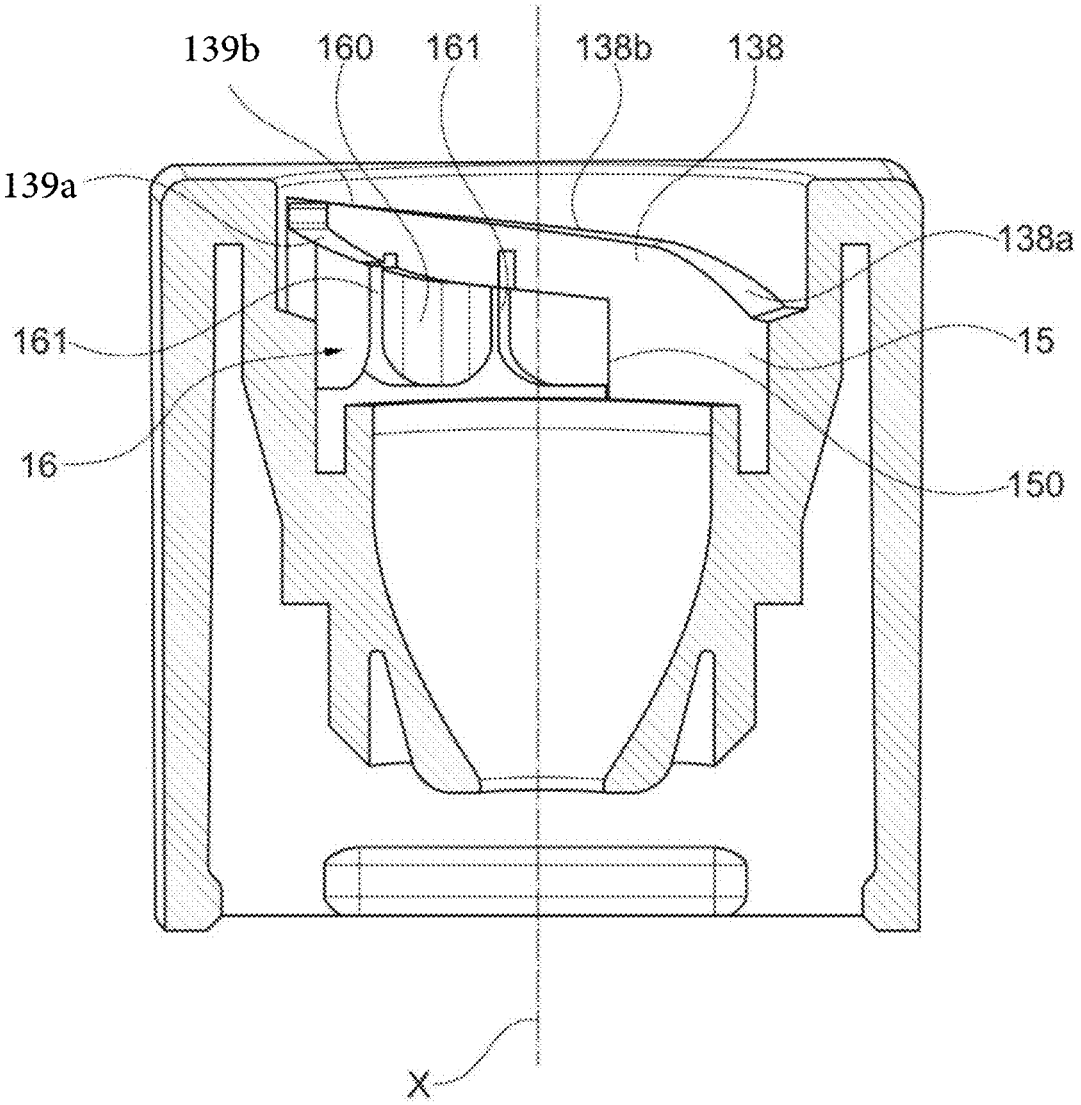

As illustrated in FIG. 9, the retaining part 130 can have two immobilizing reliefs 16 that are diametrically opposite one another. These immobilizing reliefs 16 are elastically deformable. During passage from the position closing the container to the withdrawal position, and vice versa, the fastening reliefs 122 of the applicator 12 pass over the immobilizing reliefs 16 by elastic deformation.

When the device 10 is in the closure position, the fastening reliefs 122 are retained between the adjacent edge 150 of one of the bridges of material 15 and the corresponding immobilizing relief 16. Thus, the fastening reliefs 121 are reversibly prevented from rotating. The immobilizing reliefs 16 can each have a boss 160 disposed between two notches 161. The latter make the elastic deformation of the boss 160, in particular in a radial direction, easier, and thus make it easier for each boss 160 to be passed over by the corresponding fastening relief 122. The notches 161 extend along the longitudinal axis X.

As can be seen in FIG. 9, each retaining relief 131 has a thread 138, which is generally inclined downward when turning in the clockwise direction about the longitudinal axis of the stem. This thread 138 makes it possible to guide a corresponding fastening relief 122 toward the adjacent opening 14.

The thread 138 extends in the direction of the axis X between a lower ramp surface 139*a* and an upper ramp surface 139*b*. These two surfaces have different inclinations, and the thread 138 has a variable width along the axis X.

The lower ramp surface 139*a* extends above one of the openings 14 as far as the edge 150 of one of the bridges of material 15.

The notches 161 can extend axially as far as the thread 138, as illustrated.

The upper ramp surface 139*b* of the thread 138 has a slope of variable inclination. In particular, it can have, as illustrated, an upper portion 138*b* and a lower portion 138*a* that is adjacent to the opening 14, which is more steeply inclined than the upper portion 138*b*.

The lower portion 138*a* has for example an inclination of the order of 25°.

Figure 10:
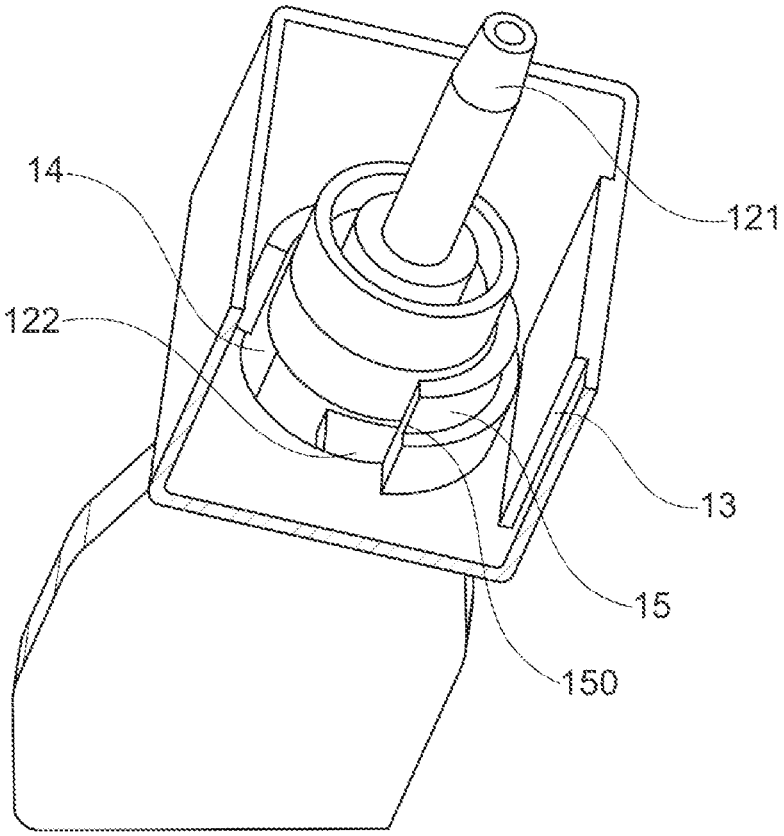
FIG. 10 shows the applicator in the closed position in the retaining and wiping component in FIG. 9.

FIG. 10 shows the applicator 12 when it is inserted in the component 13 in the position closing the container. In this position, each fastening relief 122 is disposed in an opening 14 against the edge 150 of a bridge of material 15.

In order to manufacture the component 13, a thermoplastic material, for example PE, PP or PET, is injected into a mold in two parts.

Figure 11A:
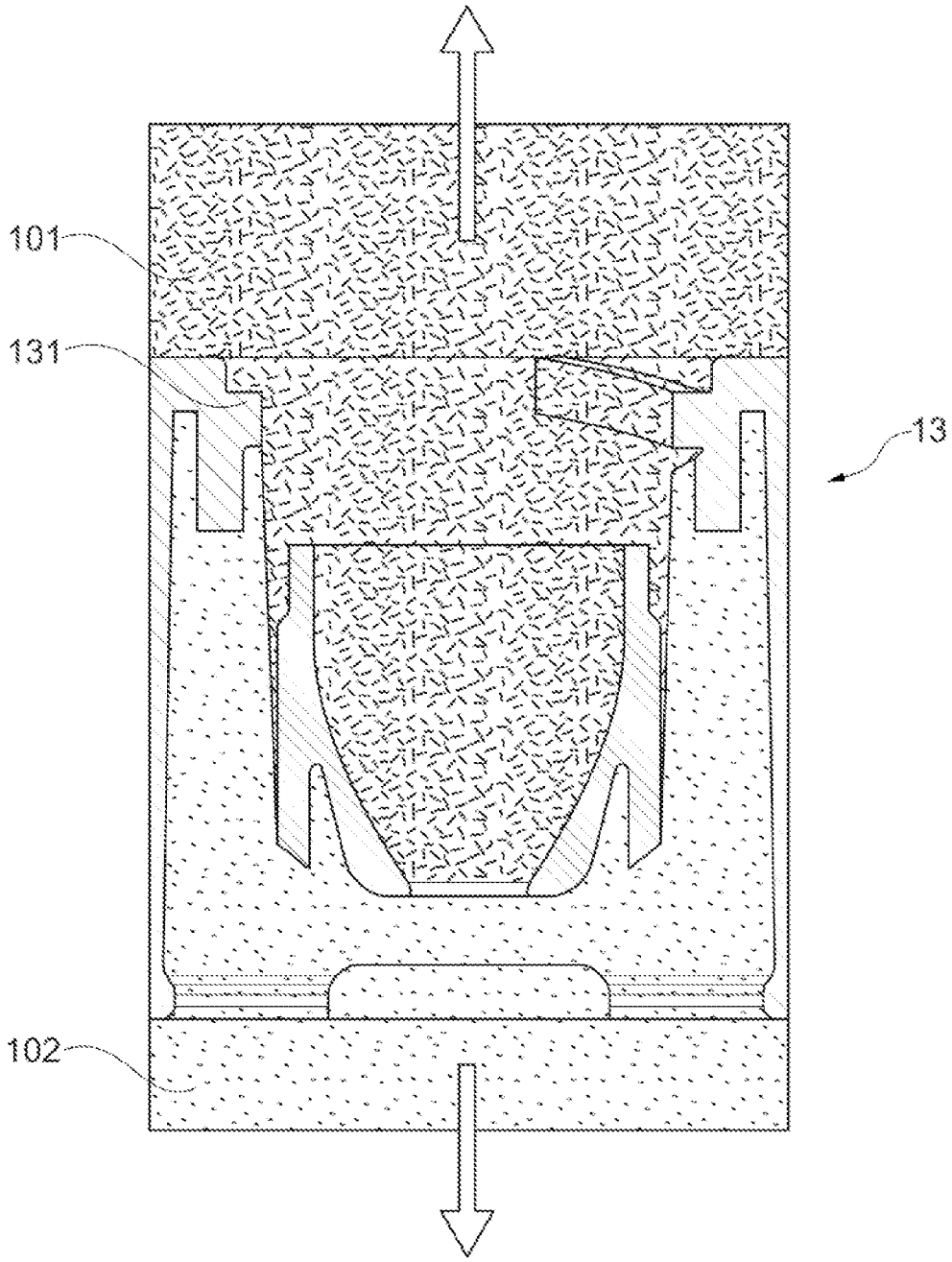
FIG. 11*a* is a view illustrating the demolding in a first section plane.
Figure 11B:
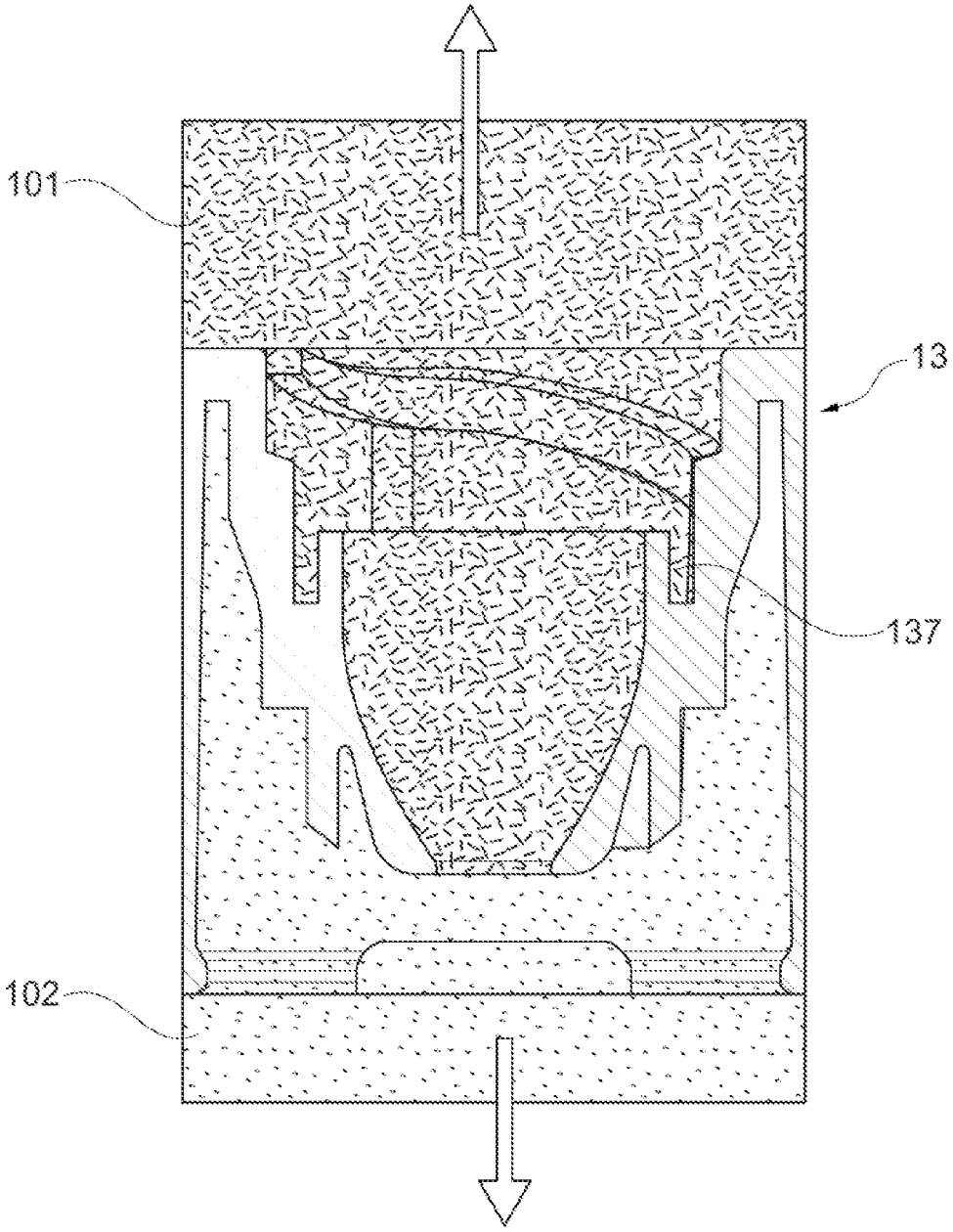
FIG. 11*b* is a view illustrating the demolding in a section plane perpendicular to that of FIG. 11*a*.

FIGS. 11*a* and 11*b* illustrate the demolding of the component 13. In these FIGS. 11*a* and 11*b*, the two parts 101 and 102 of the mold, which can move axially with respect to one another, along the axis of the component 13, are partially shown.

The shape of the component 13, and in particular the presence of the openings 15, means that there is no part that cannot be demolded.

Of course, the invention is not limited to the exemplary embodiment that has just been described, and it is possible for example to produce the retaining component and the applicator with more openings so as to obtain opening and closure in less than a quarter of a turn.

The invention claimed is:

1. A device for packaging and applying a fluid product, having:

a container for containing the product, this container having a neck, an applicator for applying the product, having an applicator member borne by a stem and at least one fastening relief protruding from the stem, and a component molded in one piece, for retaining the applicator and wiping the applicator member, fastened to the container, this component having:

a wiping part configured to press against the stem and the applicator member, extending all around a longitudinal axis of the stem when the applicator is in place in the container, and a retaining part for retaining the applicator, having at least one retaining relief beneath which said fastening relief engages when the applicator is mounted on the container, the wiping part being connected on only a portion of its periphery to the retaining part, so as to provide at least one opening beneath said retaining relief, this opening emerging axially away from the retaining relief, the component comprising bridges of material connecting the wiping part to the retaining part, the wiping part being connected on only a portion of its periphery by the bridges of material to the retaining part, the bridges of material not extending all around the longitudinal axle of the stem when the applicator is in place in the container.

2. The device according to claim 1, the retaining part having one or more immobilizing reliefs, which the fastening relief or reliefs can pass over by elastic deformation so as to reversibly prevent the applicator from rotating on the container.

3. The device according to claim 2, the retaining part having two immobilizing reliefs, which are diametrically opposite one another.

4. The device according to claim 2, the one or more immobilizing reliefs each having a boss disposed between two notches.

5. The device according to claim 1, the retaining part being configured to allow a rotation of 90° of the applicator about the longitudinal axis of the stem between a position of withdrawal of the applicator and a position closing the container.

6. The device according to claim 1, the wiping part having a wiping lip and a first sealing lip that presses against the neck of the container.

7. The device according to claim 1, the retaining part having a skirt for mounting on the container, the mounting skirt externally covering the neck of the container.

8. The device according to claim 7, one end of the mounting skirt being fastened to an annular bulge.

9. The device according to claim 8, one end of the mounting skirt being fastened to the annular bulge which is disposed at the base of the neck.

10. The device according to claim 1, the applicator having a gripping part produced in one piece with the stem.

11. The device according to claim 1, the retaining relief having a thread that is inclined downward when turning in the clockwise direction about the longitudinal axis of the stem.

12. The device according to claim 11, the thread having portions of variable inclination.

13. A method for demolding a component for retaining the applicator and wiping the applicator member of a device according to claim 1, said component being molded in a mold in two parts, the demolding being carried out by moving the two parts of the mold along the axis of the component, in opposite directions.

14. The device according to claim 1, for packaging and applying a cosmetic product.

15. A device for packaging and applying a fluid product having:

a container for containing the product, this container having a neck, an applicator for applying the product, having an applicator member borne by a stem and at least two fastening relief protruding from the stem, and a component molded in one piece, for retaining the applicator and wiping the applicator member, fastened to the container, this component having:

a wiping part configured to press against the stem and the applicator member, extending all around a longitudinal axis of the when the applicator is in place in the container, and a retaining part for retaining the applicator, having at least two retaining reliefs beneath which said fastening reliefs engage when the applicator is mounted on the container, the wiping part being connected on only a portion of its periphery to the retaining part so as to provide at least two openings beneath and retaining reliefs, this opening emerging axially away from the retaining reliefs.

16. The device according to claim 15, the applicator having only two fastening reliefs that are diametrically opposite one another.

17. A device for packaging and applying a fluid product, having:

a container for containing the product, this container having a neck, an applicator for applying the product, having an applicator member borne by a stem and at least one fastening relief protruding from the stem, and a component molded in one piece, for retaining the applicator and wiping the applicator member, fastened to the container, this component having, a wiping part configured to press against the stem and the applicator member, extending all around the longitudinal axis of the stem when the applicator is in place in the container, and a retaining part for retaining the applicator, having at least one retaining relief beneath which said fastening relief engages when the applicator is mounted on the container, the wiping part being connected on only a portion of its periphery to the retaining part, so as to provide at least one opening beneath said retaining relief, this opening emerging axially away from the retaining relief, the wiping part having a wiping lip and a first sealing lip that presses against the neck of the container the wiping part having a second sealing lip that presses against the stem of the applicator when the device is in a position closing the container.

18. The device according to claim 17, a groove being formed between the second sealing lip that presses against the stem of the applicator and a bridge of material that connects the retaining part and the wiping part.

19. The device according to claim 18, a width of the groove being between 0.1 mm and 5 mm.

* * * * *